United States Patent [19]

Iketani

[11] 4,267,540

[45] May 12, 1981

[54] HINGE-TYPE ELECTROMAGNETIC RELAY

[75] Inventor: Hiroshi Iketani, Nagaokakyo, Japan

[73] Assignee: Omron Tateisi Electronics Co., Kyoto, Japan

[21] Appl. No.: 74,827

[22] Filed: Sep. 12, 1979

[30] Foreign Application Priority Data

Nov. 1, 1978 [JP] Japan ..... 53-135222

[51] Int. Cl.[3] ..... H01H 67/02

[52] U.S. Cl. ..... 335/128; 335/133; 335/202

[58] Field of Search ..... 335/127, 128, 129, 133, 335/202, 278; 336/198

[56] References Cited

U.S. PATENT DOCUMENTS

| | | | |
|---|---|---|---|
| 3,230,329 | 1/1966 | Richert et al. | 335/128 X |
| 3,230,490 | 1/1966 | Johnson | 336/198 |
| 4,039,984 | 8/1977 | Delucia et al. | 335/202 X |
| 4,134,698 | 1/1979 | Schantz | 335/202 X |

*Primary Examiner*—George Harris
*Attorney, Agent, or Firm*—Wegner & Bretschneider

[57] ABSTRACT

A hinge-type electromagnetic relay including a spool having a first flange and a second flange which is wound with a coil, a core inserted into the spool, an armature, a yoke, a movable contact and a stationary contact, comprising a molded plastic cover unit made of electrically insulating material which has at a bottom thereof an opening portion to enclose the spool, the second flange supporting coil terminals to be connected with the coil and being disposed to close the opening portion of the cover unit, and the cover unit supporting a stationary contact terminal carrying the stationary contact.

6 Claims, 4 Drawing Figures

HINGE-TYPE ELECTROMAGNETIC RELAY

BRIEF SUMMARY OF THE INVENTION

The present invention relates a hinge-type electromagnetic relay, and more particularly to an improved hinge-type electromagnetic relay having a high dielectric strength and a sufficient insulation.

The conventional miniature hinge-type electromagnetic relay, whose electric parts, such as an electromagnet coil, a stationary contact, a movable contact, a yoke and the like, are compactly assembled, has the disadvantage that when an external surge or an impulse is applied to the electromagnet coil, an arc is sputtered from the coil to deteriorate the dielectric strength, to accelerate deterioration of the electrical parts, and to cause trouble in the operation of the relay.

It is, therefore, a primary object of the present invention to provide a hinge-type electromagnetic relay wherein even if an external surge or an impulse is applied to the coil thereof, an electric arc will not be generated between the coil and other electrical parts by means of an electrically insulated cover member covering the coil, whereby proper operation of the relay will be retained and the deterioration of the electric parts will be reduced.

It is a further object of the present invention to provide a hinge-type electromagnetic relay wherein a stationary contact assembly and a electromagnet assembly form a single block, which is easy to assemble.

Other objects as well as the numerous advantages of the hinge-type electromagnetic relay according to the present invention will become apparent from the following detailed description and the accompanying drawings, in which:

DETAILED DESCRIPTION

Figure 1:
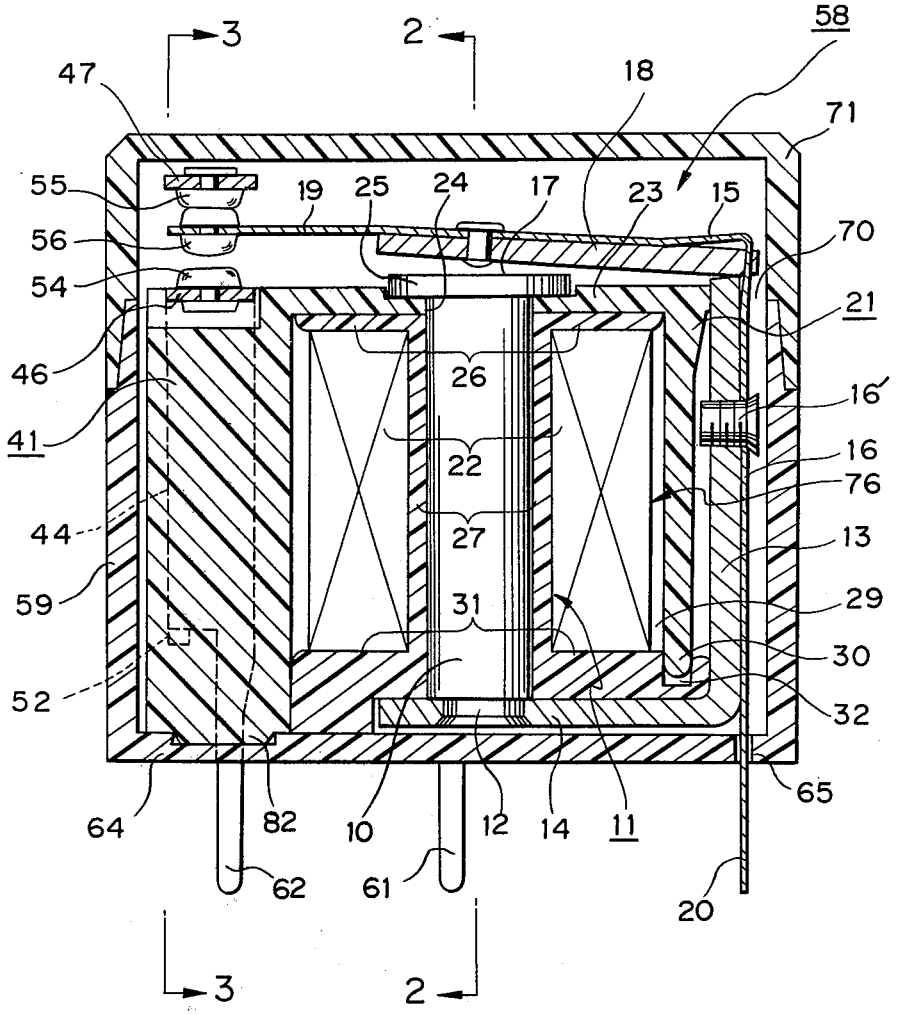
FIG. 1 is a longitudinal sectional view of a hinge-type electromagnetic relay as one embodiment of the present invention.

Referring, now, to FIG. 1, there is shown a direct current hinge-type electromagnetic relay according to the present invention, in which a core 10 is engaged with a spool 11 consisting of an upper flange 26, a central portion 27 and a lower flange 31, and a base end 12 of said core is secured to a base 14 of a yoke 13 by caulking. A hinge spring 15 is fixed at a base 16 thereof to the yoke 13 by a screw 16', and is riveted to an armature 18 opposite a magnetic pole-face 17 which is formed on a head portion of the core 10. The hinge spring 15 forms at one end thereof a forwardly extending movable blade 19 and at the other end thereof a downwardly extending external terminal 20.

Figure 4:
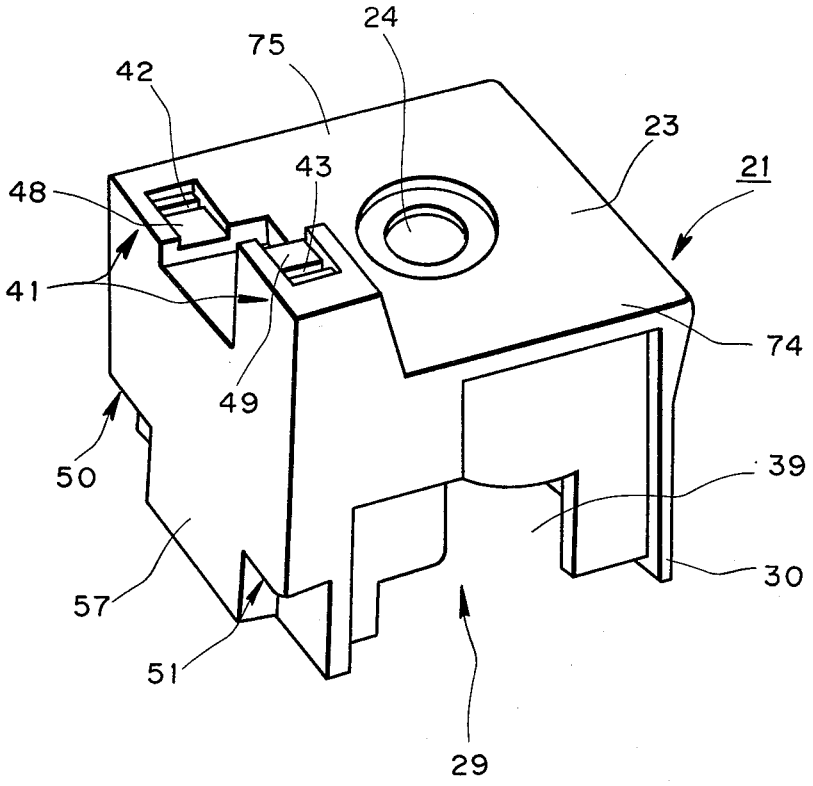
FIG. 4 is a perspective view of an electrically insulated cover which is employed in the relay of FIG. 1.

An electrically insulated cover 21 is a molded plastic cover in the shape of a bottom with its bottom side open as shown in FIG. 4 and encloses a spool 11 and a coil 22 wound thereon. A head portion 23 of the cover 21 has a hole 24 adapted to engage the core 10, and the core 10 is inserted through the hole 24 into the spool 11. The head portion 23 of the cover 21 is located between an annular projection 25 of the core 10 and the upper flange 26, and is fixed by the annular projection 25 and the base end 12 of the core 10. Thus, as the core 10 is secured to the yoke 13 by caulking, the cover 21 is also secured at the head portion 23 to the upper flange 26.

A projection 30 is formed on a peripheral portion of a bottom opening 29 of the cover 21 and positioned between the coil 22 and the yoke 13, and is engaged with a recess 32 formed in the lower flange 31, whereby the cover 21 is positioned and fixed onto the spool 11, and a creepage distance of insulation between the coil 22 and the yoke 13 is increased.

Figure 2:
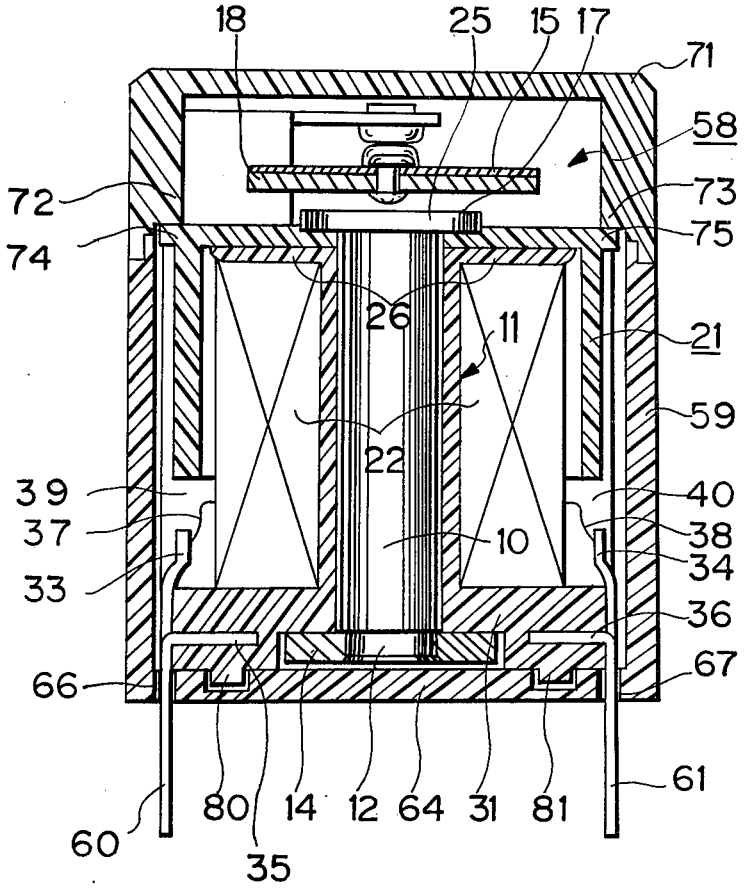
FIG. 2 is a transverse sectional view taken along the line 2—2 of FIG. 1.

The opening 29 is closed by the lower flange 31. As shown in FIG. 2, a pair of coil terminals 60 and 61 are embedded at bases 35 and 36 thereof in the lower flange 31, and are connected at top ends 33 and 34 thereof with a pair of ends 37 and 38 of the coil 22 through cutout portions 39 and 40 of the cover 21, respectively. The cutout portions 39 and 40 are formed in side walls of the cover 21 as shown in FIGS. 2 and 4, and are adapted to allow heat from the coil 22 to be raidated therethrough.

Figure 3:
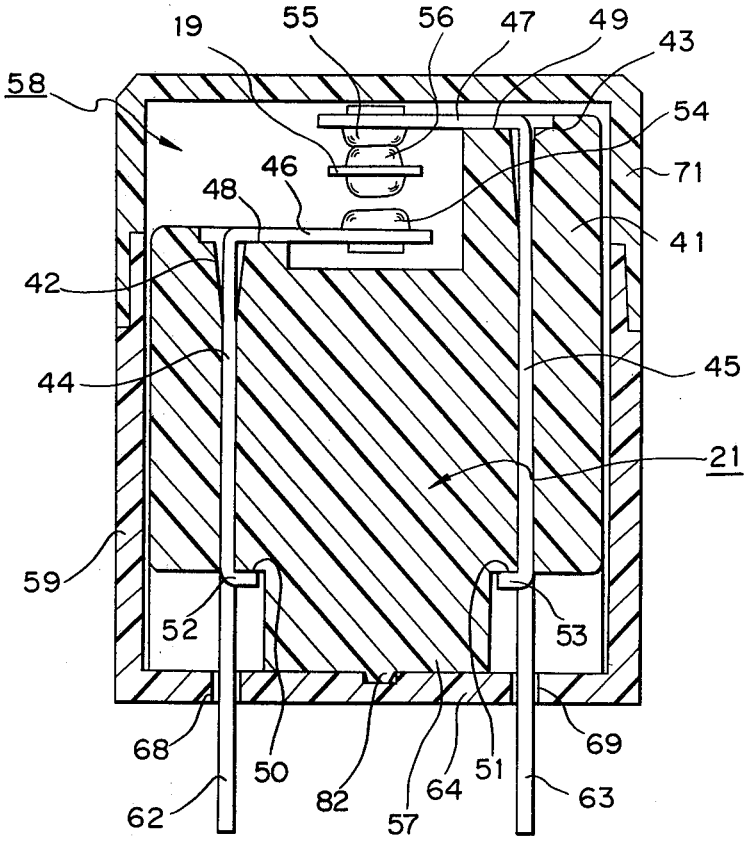
FIG. 3 is a transverse sectional view taken along the line 3—3 of FIG. 1.

Referring to FIGS. 1, 3 and 4, there is illustrated a terminal stand 41 which is formed in the cover 21 as a continuing portion of the same. In the terminal stand 41 a pair of openings 42 and 43 are formed so as to be pierced by a pair of stationary contact terminals 44 and 45 from above. The stationary contact terminals 44 and 45 respectively have a pair of bent portions 46 and 47 which are engaged with top wall surfaces 48 and 49 of the terminal stand 41 so as to prevent the terminals 44 and 45 from dropping. The terminals 44 and 45 respectively have a pair of bent tongues 52 and 53 which are engaged with step portions 50 and 51 of the terminal stand 41 so as to prevent the terminals 44 and 45 from slipping out.

During assembly, after the terminals 44 and 45 have been thrusted into the openings 42 and 43, the tongues 52 and 53 will be bent toward the step portions 50 and 51. If the terminals 44 and 45 can be firmly secured to the stand 41 without the tongues 52 and 53, however, the tongues may be omitted for a simpler assembly of the relay.

A pair of stationary contacts 54 and 55 are carried by the bent portions 46 and 47, respectively, and a movable contact 56 carried by the movable blade 19 is positioned therebetween. As shown in FIGS. 3 and 4, a projection 57 is formed on a bottom portion of the cover 21 in a position between the stationary contact terminals 44 and 45 so as to provide an increased creepage distance therebetween. The cover 21 further has on the bottom wall surface a projection 82 as shown in FIGS. 1 and 3 to provide another increased creepage distance between the terminals 44 and 45. Thus, the dielectric strength between the stationary contact terminals 44 and 45 is improved. A pair of projections 80 and 81 formed on the lower flange 31 as shown in FIG. 2 provide for increased creepage distances between the base 14 of the yoke 13 and the coil terminal 60, and the base 14 and the coil terminal 61, respectively.

A relay body 58 having the above described construction is enclosed between and within an upper and a lower case 71 and 59. As the relay body 58 is enclosed in the lower case 59, the terminals 20, 60, 61, 62 and 63 will pierce a bottom wall 64 of the case 59 which includes holes 65, 66, 67, 68 and 69 to be engaged by the all terminals, respectively. Thereafter, the upper case 71 will be mounted on the lower case 59 across an upper opening 70 of the case 59. As the case 71 is mounted on the case 59, a pair of projections 72 and 73 formed on an inner surface of a side wall of the case 71 will be engaged with a pair of shoulders 74 and 75 of the cover 21, whereby the relay body 58 including the cover 21 will be fixed within the assembly of cases 59 and 71. Alternatively, the relay body 58 alone without the cases 59 and 71 may be used as an exposed-type relay.

When the coil 22 is energized, the armature 18 will be attracted by the pole-face 17 of the core 10 and the movable contact 56 will leave the stationary contact 55 and come into contact with the stationary contact 54. On the contrary, when the coil 22 is de-energized, the armature 18 will leave the pole-face 17 in response to an annihilating force of the hinge-spring 15 and the movable contact 46 will leave the contact 54 and come in contact with the contact 55.

Since the coil 22 is covered with the electrically insulated cover 21, even if an external surge or an impulse is applied to the coil 22 on energization thereof, no electric arc will be generated between the coil 22 and the yoke 13 or between the two confronting terminals 44 and 45, so that the relay according to the present embodiment may have a high dielectric strength.

The terminal stand 41 supporting the stationary contact terminals 44 and 45 is molded with the cover 21 as a unit, and the terminals 44 and 45 and an electromagnet device 76 including the coil 22 form a single block. In this manner, the relay body 58 can be easily assembled into the lower cover 59.

The electrically insulated cover 21 and the spool 11 are secured together by the core 10 between the annular projection 25 and the base end 12. In order to more firmly secure the spool 11 and the cover 21 together, the upper flange 26 may have on the top wall surface thereof a projection and the cover 21 may have at the head portion 23 a hole corresponding to the projection so that the projection and the hole may be jointed together by the application of heat.

Alternatively, the yoke 13 and the core 10 may be a U-shaped continuous unit without having the annular projection 25, wherein the cover 21 and the spool 11 may be secured together with the U-shaped unit by a fastening member which is engaged with one end of the U-shaped unit projecting through the hole 24 of the cover 21. When an alternating current relay having a shading piece is employed, the shading piece may be used as a fastening member for affixing the core 10 to the cover 21 and the spool 11.

it will be understood from the foregoing that the hinge-type electromagnetic relay according to the present invention has extremely high dielectric strength and is easy to assemble.

It should be understood that the above description is merely illustrative of the present invention and that many changes and modifications may be made by those skilled in the art without departing from the scope of the appended claims.

What is claimed:

1. In a hinge-type electromagentic relay including a spool member having first and second flanges which is wound with a coil, a core member which extends through a hole formed in the spool member, an armature member which upon energization of the coil is attracted by said core member, a yoke member which is connected between the core member and the armature member, a movable contact member carried by the armature member, and a stationary contact member corresponding to the movable contact member, the improvement comprising an electrically non-conductive molded plastic cover unit with its bottom side open for housing said spool member, said cover unit supporting a stationary contact terminal member carrying said stationary contact member, said bottom side of cover member being closed by said second flange, and said second flange being provided with a plurality of coil terminal members to be connected to said coil.

2. A hinge-type electromagentic relay according to claim 1, wherein said core member includes at a head portion thereof a projection and is secured at a bottom end thereof to said yoke member, whereby said cover unit and said spool member are secured together by said projection and said bottom end of core member.

3. A hinge-type electromagentic relay according to claim 1, wherein said second flange includes a recessed portion between said coil and said yoke member, said recessed portion being adapted to engage a projecting portion of said cover unit, said projecting portion being formed around said open bottom.

4. A hinge-type electromagnetic relay according to claim 1, wherein said stationary contact terminal member comprises a plurality of terminals, and said cover unit includes a projection between said plurality of stationary contact terminals to thereby provide for an increased creepage distance therebetween.

5. A hinge-type electromagnetic relay according to claim 1, wherein said second flange has on a lower surface thereof a projection between said yoke member and said terminal members to thereby provide for an increased creepage distance therebetween.

6. A hinge-type electromagentic relay according to claim 1, further comprising a first case and a second case which, taken together, form a single box for enclosing said relay, said second case having a bottom side thereof a pluraity of holes through which all of said terminal members extend outwardly, and said first case having at least a member for securing said relay in position with respect to said first and second cases.

* * * * *